US006842145B1

(12) United States Patent
Ryken, Jr. et al.

(10) Patent No.: US 6,842,145 B1
(45) Date of Patent: Jan. 11, 2005

(54) REDUCED SIZE GPS MICROSTRIP ANTENNA

(75) Inventors: Marvin L. Ryken, Jr., Oxnard, CA (US); Albert F. Davis, Ventura, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 20 days.

(21) Appl. No.: 10/627,045

(22) Filed: Jul. 28, 2003

(51) Int. Cl.[7] ..... H01Q 1/38

(52) U.S. Cl. ..... 343/700 MS; 343/726; 343/846

(58) Field of Search ..... 343/700 MS, 725, 343/726, 829, 846, 850

(56) References Cited

U.S. PATENT DOCUMENTS 4,291,311 A * 9/1981 Kaloi ..... 343/700 MS
4,356,492 A * 10/1982 Kaloi ..... 343/700 MS
5,241,322 A * 8/1993 Gegan ..... 343/700 MS
5,400,040 A * 3/1995 Lane et al. ..... 343/700 MS
5,400,041 A * 3/1995 Strickland ..... 343/700 MS
5,945,938 A * 8/1999 Chia et al. ..... 342/42
6,031,503 A * 2/2000 Preiss et al. ..... 343/770
6,343,208 B1 * 1/2002 Ying ..... 455/575.7

* cited by examiner

*Primary Examiner*—Shih-Chao Chen
(74) *Attorney, Agent, or Firm*—David S. Kalmbaugh

(57) ABSTRACT

A reduced size microstrip antenna which receives GPS data and which is adapted for use on small diameter weapons systems such as a missile or smart bomb. The microstrip antenna has a center frequency of 1.575 GHz, a frequency bandwidth of twenty megahertz and provides for right hand circular polarization. The microstrip antenna includes a pair of quarter-wavelength antennas which have a rectangular shape and are rotated ninety degrees from one another, and a copper etched feed network which provides for a signal phase shift of ninety degrees.

20 Claims, 4 Drawing Sheets

REDUCED SIZE GPS MICROSTRIP ANTENNA

BACKGROUND OF THE INVENTION

1. Field of the Invention

The present invention relates generally to a microstrip antenna for use on a weapons system to receive externally generated data. More specifically, the present invention relates to a reduced size microstrip antenna which receives GPS data and which is adapted for use on small diameter weapons systems such as a missile.

2. Description of the Prior Art

There is currently a need for a miniature microstrip antenna which receives GPS (Global Positioning System) data for use on a small diameter weapons system such as a missile, a artillery shell, smart bomb or the like. The antenna needs to operate at the GPS L1 Band and have a center frequency of 1.575 GHz, frequency bandwidth of twenty megahertz and right hand circular polarization.

In the past, microstrip antennas have utilized an increase in the dielectric constant to decrease the physical size of the antenna. The limitations of utilizing a higher dielectric constant for the microstrip antenna include a narrowing of the frequency bandwidth and a increased sensitivity to frequency change. Other microstrip antenna designs have used in the center of the microstrip antenna that the electric field emanates around the slot which effectively increases the electrical length of the microstrip antenna. However, this increased electrical length results in a lowering of the frequency of operation of the antenna.

Accordingly, there is a need for a mircrostrip antenna which is substantially reduced in size, does not require a high dielectric constant and which operates in the GPS L1 Band.

SUMMARY OF THE INVENTION

The present invention overcomes some of the disadvantages of the past including those mentioned above in that it comprises a relatively simple in design yet highly effective and efficient miniaturized microstrip antenna which can receive GPS data provided by a satellite or other source for providing GPS data.

The reduced size GPS microstrip antenna operates at the GPS L Band which allows the microstrip antenna to receive GPS antenna. The GPS microstrip antenna also has a center frequency of 1.575 GHz, a frequency bandwidth of twenty megahertz and provides for right hand circular polarization.

The GPS microstrip antenna includes a pair of quarters wavelength antennas which have a rectangular shape and are rotated ninety degrees from one another. The copper etched feed network for the antennas provides for a signal phase shift of ninety degrees.

The upper surface of the GPS microstrip antenna is fabricated from etched copper and is mounted on the upper surface an antenna dielectric substrate. The GPS microstrip antenna also has a feed dielectric substrate which is positioned below and in alignment with the antenna dielectric substrate. Sandwiched between the feed dielectric substrate and antenna dielectric substrate is the feed network. The ground plane is mounted on the bottom surface of the feed dielectric substrate.

DETAILED DESCRIPTION OF THE DRAWINGS

Figure 1:
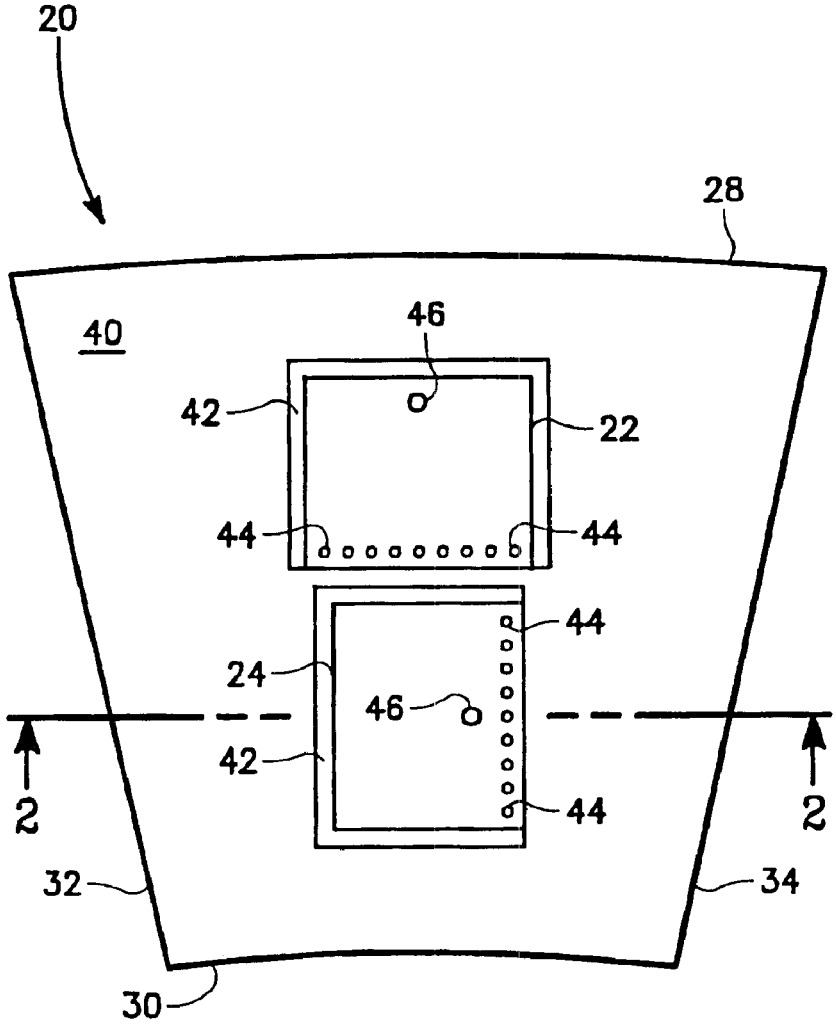
FIG. 1 is a top view of an embodiment of the reduced size GPS microstrip antenna constituting the present invention.

Referring to FIG. 1, there is shown a reduced size GPS microstrip antenna, designated generally by the reference numeral 20, which is adapted to receive GPS data from an external source such as satellite. GPS microstrip antenna 20 is designed to operate at GPS L-Band, i.e. receive L-Band GPS carrier signals from a satellite or other source for generating GPS data and transmitting the GPS data utilizing an L-Band GPS carrier signal/radio frequency signal. GPS microstrip antenna 20 also a frequency bandwidth of twenty megahertz and provides for right hand circular polarization.

Figure 2:
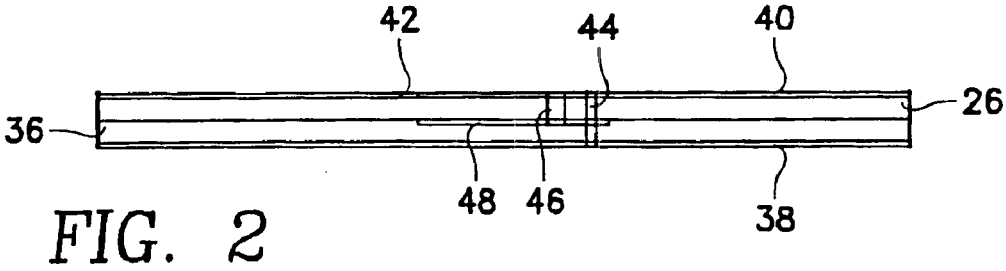
FIG. 2 is a side view of the reduced size GPS microstrip antenna taken along line 2—2 of FIG. 1.

Referring to FIGS. 1 and 2, GPS microstrip antenna 20 includes a pair of quarter wavelength antennas 22 and 24 which are mounted on an antenna dielectric substrate. As shown in FIG. 1, quarter wavelength antennas 22 and 24 are physically separated for each other. Each antenna 22 and 24 is rectangular in shape and each antenna 22 and 24 has an overall length of 0.750 inches and an overall width of 0.650 inches. Antenna 22 is physically rotated ninety degrees from antenna 24.

The dielectric substrate 26 upon which quarter wavelength antennas 22 and 24 are mounted has a conical wedge shape as shown in FIG. 1. The overall dimension for the upper or top edge 28 of antenna 20 is 2.236 inches, the overall dimension for the lower or bottom edge 30 of antenna 20 is 1.450 inches and the overall dimension for the side edges 32 and 34 of antenna 20 is 1.993 inches.

There is a feed dielectric substrate 36 positioned below dielectric substrate 26 which is in alignment with dielectric substrate 26. A ground plane 38 is mounted on the bottom surface of dielectric substrate 36.

Each dielectric substrate 26 and 36 has an overall width of 0.046 inches and may be fabricated from a laminate material RT/Duroid 6002 commercially available from Rogers Corporation of Rogers Conn. This material allows sufficient strength and physical and electrical stability to satisfy environmental requirements and is also easily mounted within a missile, smart bomb or other weapons which utilizes GPS microstrip antenna 20 to receive GPS carrier signals provided by a satellite.

The upper or top surface of microstrip antenna 20 has a layer of etched copper 40 mounted thereon which surrounds quarter wavelength antennas 22 and 24. There is a 0.050 inch three-sided gap 42 formed on three sides of each antenna 22 and 24 which is positioned such that one of the sides of gap 42 runs along the length of each of the quarter wavelength antennas 22 and 24 and two sides of gap 42 run along each side of the quarter wavelength antennas 22 and 24.

Each quarter wavelength antenna 22 and 24 is grounded to the ground plane 38 by eighteen vias or copper connecting plated through holes 44 which pass through dielectric substrates 26 and 36 in the manner shown in FIG. 2.

Figure 3:
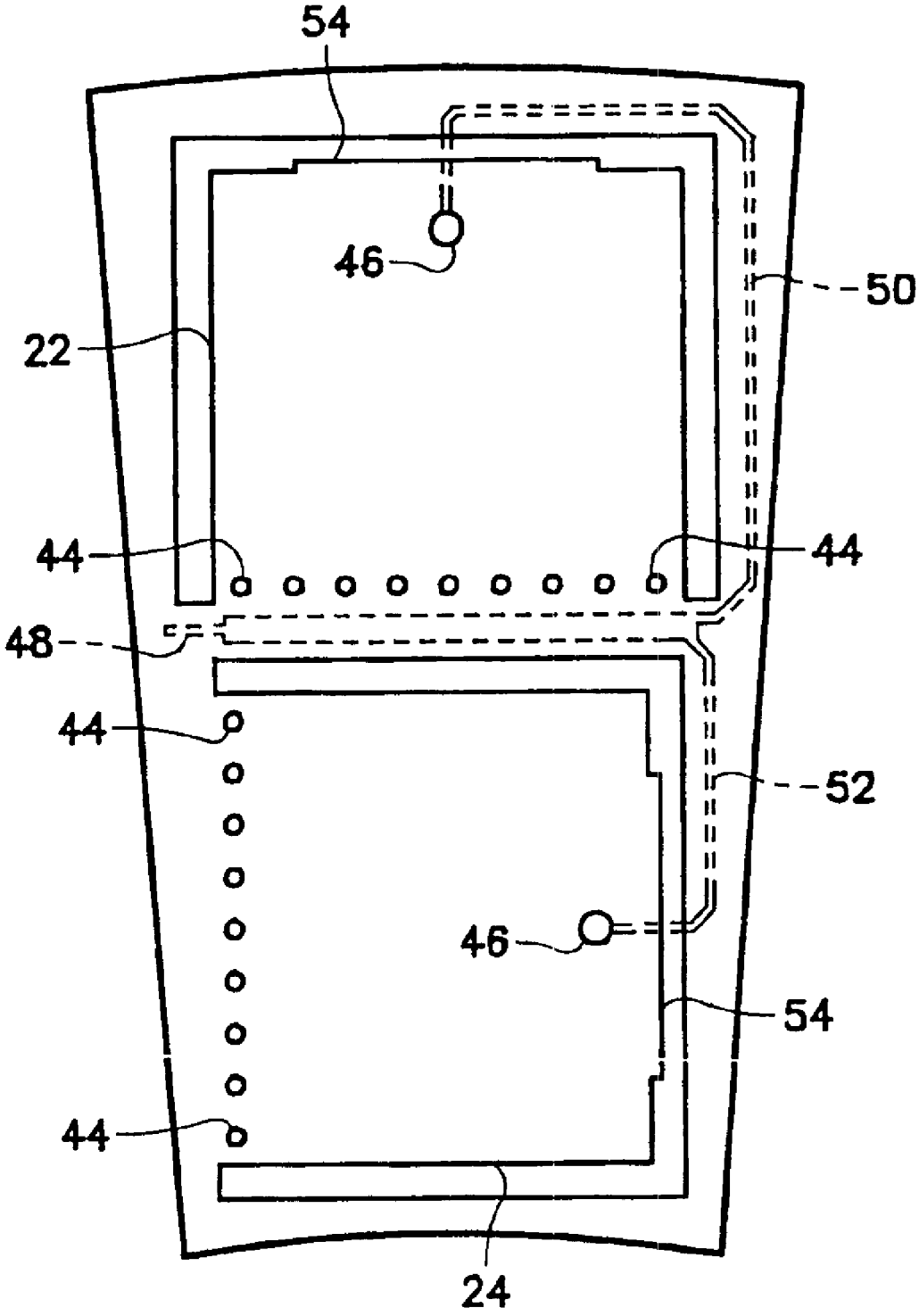
FIG. 3 is a top view of another embodiment of the reduced size GPS microstrip antenna of FIG. 1 which includes tuning tabs for fine tuning the center frequency of the GPS microstrip antenna.

Referring to FIGS. 2 and 3, each quarter wavelength antenna 22 and 24 has a feed point 46 which connects the quarter wavelength antenna to the copper etched feed network 48 for microstrip antenna 20. The feed point 46, which is a copper feed for each quarter wavelength antenna 22 and 24 corresponds to a 100 ohm input impedance. The feed network 46 for microstrip antenna 20 is a power divider with an excess phase shift of 90° of the electrical signal occurring during transmission of the signal through the network 48 from the feed points 46 for quarter wavelength antennas 22 and 24. The feed network 46 includes two feed lines/transmission lines 50 and 52 with feed line 50 providing a signal path for quarter wavelength antenna 22 and feed line 52 providing a signal path for quarter wavelength antenna 24. One of the two quarter wavelength antennas of the GPS microstrip antenna 20 has a feed line length which provides for the 90 degree phase shift of the received RF signal relative to the feed line for the other quarter wavelength antenna. The feed network 46 matches an input 50 ohm impedance to the antenna input (i.e. feed points 46) 100 ohm impedances.

Each quarter wavelength antenna 22 and 24 also has a tuning tab 54 formed along the edge of the quarter wavelength antenna which is in proximity to the feed point 46 for the quarter wavelength antenna. The tuning tab 54 for each antenna 22 and 24 is utilized to fine tune the center frequency of 1.575 GHz for GPS microstrip antenna 20.

In operation, utilizing the two quarter-wavelength microstrip antennas 22 and 24 and feeding the antennas 22 and 24 ninety degrees out of phase with one another achieves circular polarization. The electric field vectors for the quarter wavelength microstrip antennas 22 and 24 are orthogonal to each other. Electromagnetic radiation emanates from the three-sided gap 42 formed on three sides of each antenna 22 and 24.

Figure 4:
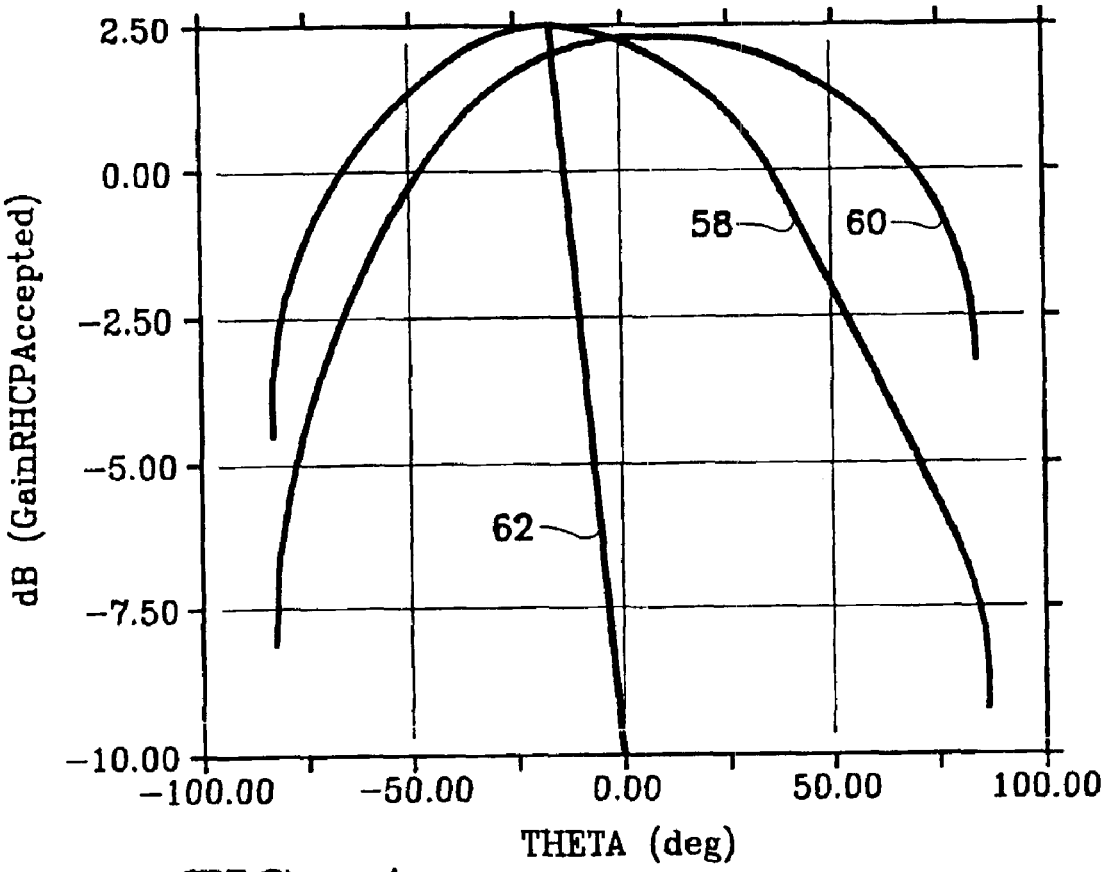
FIGS. 4 and 5 are plots which illustrate performance characteristics of the reduced size GPS microstrip antenna of FIG. 1.
Figure 5:
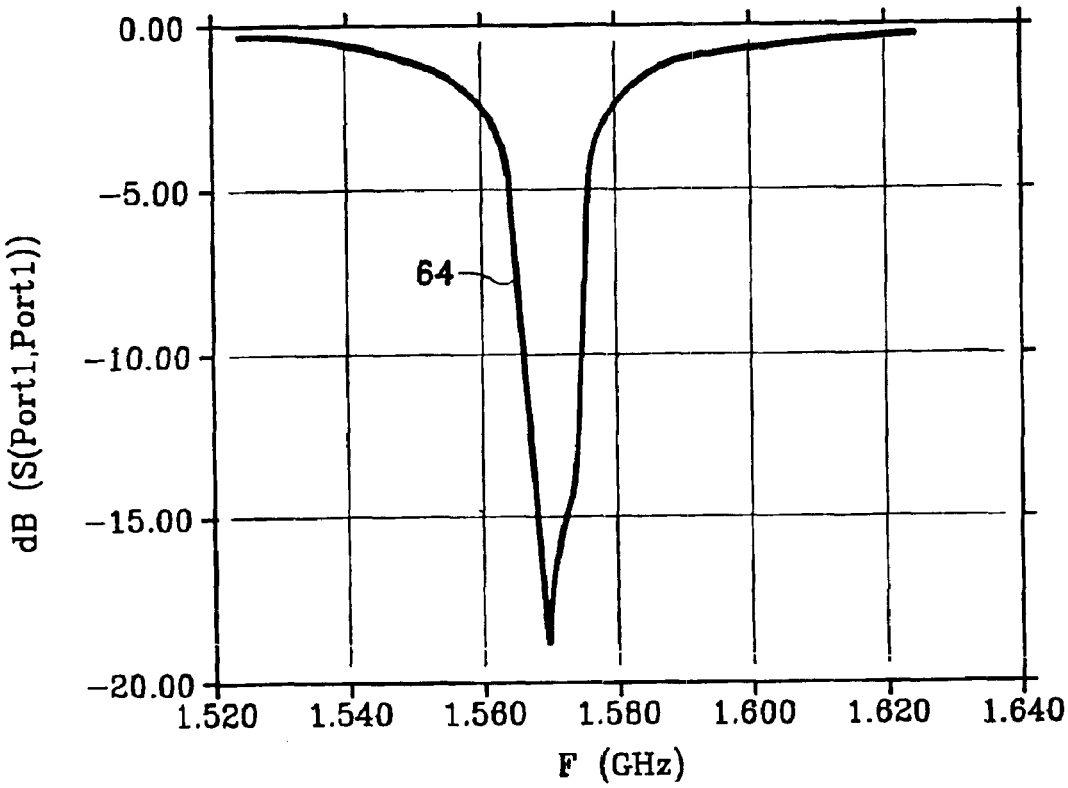

Referring to FIGS. 4 and 5, FIGS. 4 and 5 are plots which illustrate performance characteristics of the reduced size GPs microstrip antenna 20. FIG. 4 includes a pair of plots 58 and 60 which illustrate the radiation pattern for quarter wavelength antennas 22 and 24. Plot 58 has phase shift equal to ninety degrees (phi=90 deg). Plot 58 has a zero degree phase shift (phi=0 deg). Plot 62 depicts a fifteen degree look back or tilt for the GPS microstrip antenna radiation pattern. FIG. 5 includes a plot 64 which illustrates element return loss at a resonant frequency of about 1.575 GHz which is the center frequency for GPS microstrip antenna 20.

From the foregoing, it is readily apparent that the present invention comprises a new, unique and exceedingly useful miniaturized microstrip antenna for receiving GPS carrier signals which constitutes a considerable improvement over the known prior art. Many modifications and variations are possible in light of the above teachings. It is therefore to be understood that within the scope of the appended claims that the invention may be practiced otherwise than as specifically described.

What is claimed is:

1. A reduced size GPS microstrip antenna comprising:

(a) a first dielectric substrate;

(b) a second dielectric substrate mounted on an upper surface of said first dielectric substrate;

(c) a ground plane mounted on a bottom surface of said first dielectric substrate;

(d) a shaped layer of etched copper mounted on an upper surface of said second dielectric substrate;

(e) first and second rectangular shaped quarter-wavelength microstrip antennas mounted on said upper surface of said second dielectric substrate, said first and second quarter-wavelength microstrip antennas being spaced apart from and electrically separated from said ground plane by said first and second dielectric substrates, said first and second quarter-wavelength mcirostrip antennas being adapted to receive an RF carrier signal containing GPS (Global Positioning System) data;

(f) said first quarter-wavelength microstrip antenna being rotated ninety degrees with respect to said second quarter-wavelength microstrip antenna on the upper surface of said second dielectric substrate;

(g) a feed network mounted on the upper surface of said first dielectric substrate, said feed network having one end of a first feed line and one end of a second feed line connected thereto, said first feed line having an opposite end thereof connected to said first quarter-wavelength microstrip antenna, said second feed line having an opposite end thereof connected to said second quarter-wavelength microstrip antenna, said first and second feed lines forming a power divider which provides for a phase shift of 90° of an electrical equivalent signal of said RF carrier signal when transmitted through said first and second feed lines; and (h) said phase shift of said electrical equivalent signal and said first quarter-wavelength microstrip antenna being rotated ninety degrees with respect to said second quarter-wavelength microstrip antenna, providing for a circular polarization of said GPS microstrip antenna.

2. The reduced size GPS microstrip antenna of claim 1 wherein each of said first and second shaped quarter-wavelength microstrip antennas has an overall length of 0.750 inches and an overall width of 0.650 inches.

3. The reduced size GPS microstrip antenna of claim 1 wherein each of said first and second quarter-wavelength microstrip antennas is connected to said ground plane by a plurality of copper plated through holes passing through said first and second dielectric substrates.

4. The reduced size GPS microstrip antenna of claim 1 wherein each of said first and second quarter-wavelength microstrip antennas includes a copper feed which passes through said second dielectric substrate and connects said first feed line to said first quarter-wavelength microstrip antenna and said second feed line to said second quarter-wavelength microstrip antenna.

5. The reduced size GPS microstrip antenna of claim 1 wherein said reduced size microstrip antennas has a center frequency of 1.575 GHz and a frequency bandwidth of twenty megahertz.

6. The reduced size GPS microstrip antenna of claim 5 wherein each of said first and second quarter-wavelength microstrip antennas includes a tuning tab for fine tuning the center frequency for said GPS microstrip antenna.

7. The reduced size CPS microstrip antenna of claim 1 wherein each of said first and second dielectric substrates has a thickness of approximately 0.046 inches.

8. A reduced size GPS microstrip antenna comprising:

(a) a first conical wedge shaped dielectric substrate;

(b) a second conical wedge shaped dielectric substrate mounted on an upper surface of said first dielectric substrate;

(c) a ground plane mounted on a bottom surface of said first dielectric substrate;

(d) a conical wedge shaped layer of etched copper mounted on an upper surface of said second dielectric substrate;

(e) first and second rectangular shaped quarter-wavelength microstrip antennas mounted on said upper surface of said second dielectric substrate, said first and second quarter-wavelength microstrip antennas being spaced apart from and electrically separated from said ground plane by said first and second dielectric substrates, said first and second quarter-wavelength mcirostrip antennas being adapted to receive an RF carrier signal containing GPS (Global Positioning System) data;

(f) said first quarter-wavelength microstrip antenna being rotated ninety degrees with respect to said second quarter-wavelength microstrip antenna on the upper surface of said second dielectric substrate;

(g) a feed network mounted on the upper surface of said first dielectric substrate, said feed network having one end of a first feed line and one end of a second feed line connected thereto, said first feed line having an opposite end thereof connected to said first quarter-wavelength microstrip antenna, said second feed line having an opposite end thereof connected to said second quarter-wavelength microstrip antenna, said first and second feed lines forming a power divider which provides for a phase shift of 90° of an electrical equivalent signal of said RF carrier signal when transmitted through said first and second feed lines;

(h) said phase shift of said electrical equivalent signal and said first quarter-wavelength microstrip antenna being rotated ninety degrees with respect to said second quarter-wavelength microstrip antenna, providing for a circular polarization of said GPS microstrip antenna;

(i) each of said first and second quarter-wavelength microstrip antennas including a tuning tab for fine tuning a center frequency for said GPS microstrip antenna, said center frequency for said GPS microstrip antenna being approximately 1.575 GHz; and (j) a first three-sided gap position around three sides of said first rectangular shaped quarter-wavelength microstrip antenna and a second three-sided gap position around three sides of said second rectangular shaped quarter-wavelength microstrip antenna, wherein an electromagnetic radiation pattern for said GPS microstrip antenna emanates from said first three-sided gap and said second three-sided gap.

9. The reduced size GPS microstrip antenna of claim 8 wherein said first three-sided gap and said second three-sided gap each have a width of 0.050 inches exposing about 0.050 inches of the upper surface of said second dielectric substrate in alignment with said first three-sided gap and said second three-sided gap.

10. The reduced size GPS microstrip antenna of claim 8 wherein each of said first and second shaped quarter-wavelength microstrip antennas has an overall length of 0.750 inches and an overall width of 0.650 inches.

11. The reduced size GPS microstrip antenna of claim 8 wherein each of said first and second quarter-wavelength microstrip antennas is connected to said ground plane by a plurality of copper plated through holes passing through said first and second dielectric substrates.

12. The reduced size GPS microstrip antenna of claim 11 wherein said plurality of copper plated through holes comprises eighteen copper plated through holes.

13. The reduced size GPS microstrip antenna of claim 8 wherein each of said first and second quarter-wavelength microstrip antennas includes a copper feed which passes through said second dielectric substrate and connects said first feed line to said first quarter-wavelength microstrip antenna and said second feed line to said second quarter-wavelength microstrip antenna.

14. The reduced size GPS microstrip antenna of claim 8 wherein each of said first and second dielectric substrates has a thickness of approximately 0.046 inches.

15. A reduced size GPS microstrip antenna comprising:

(a) a first conical wedge shaped dielectric substrate;

(b) a second conical wedge shaped dielectric substrate mounted on an upper surface of said first dielectric substrate;

(c) a ground plane mounted on a bottom surface of said first dielectric substrate;

(d) a conical wedge shaped layer of etched copper mounted on an upper surface of said second dielectric substrate;

(e) first and second rectangular shaped quarter-wavelength microstrip antennas mounted on said upper surface of said second dielectric substrate, said first and second quarter-wavelength microstrip antennas being spaced apart from and electrically separated from said ground plane by said first and second dielectric substrates, said first and second quarter-wavelength mcirostrip antennas being adapted to receive an RF carrier signal containing GPS (Global Positioning System) data, each of said first and second quarter-wavelength microstrip antennas being connected to said ground plane by a plurality of copper plated through holes passing through said first and second dielectric substrates;

(f) said first quarter-wavelength microstrip antenna being rotated ninety degrees with respect to said second quarter-wavelength microstrip antenna on the upper surface of said second dielectric substrate;

(g) a feed network mounted on the upper surface of said first dielectric substrate, said feed network having one end of a first feed line and one end of a second feed line connected thereto, said first feed line having an opposite end thereof connected to said first quarter-wavelength microstrip antenna, said second feed line having an opposite end thereof connected to said second quarter-wavelength microstrip antenna, said first and second feed lines forming a power divider which provides for a phase shift of 90° of an electrical equivalent signal of said RF carrier signal when transmitted through said first and second feed lines;

(h) said phase shift of said electrical equivalent signal and said first quarter-wavelength microstrip antenna being rotated ninety degrees with respect to said second quarter-wavelength microstrip antenna, providing for a circular polarization of said GPS microstrip antenna;

(i) each of said first and second quarter-wavelength microstrip antennas including a tuning tab for fine tuning a center frequency for said GPS microstrip antenna, said center frequency for said GPS microstrip antenna being approximately 1.575 GHz;

(j) each of said first and second quarter-wavelength microstrip antennas including a copper feed which passes through said second dielectric substrate and connects said first feed line to said first quarter-wavelength microstrip antenna and said second feed line to said second quarter-wavelength microstrip antenna;

(k) a first three-sided gap position around three sides of said first rectangular shaped quarter-wavelength microstrip antenna and a second three-sided gap position around three sides of said second rectangular shaped quarter-wavelength microstrip antenna, wherein an electromagnetic radiation pattern for said GPS microstrip antenna emanates from said first three-sided gap and said second three-sided gap; and (l) said GPS microstrip antenna having a frequency bandwidth of twenty megahertz.

16. The reduced size GPS microstrip antenna of claim 15 wherein said first three-sided gap and said second three-sided gap each have a width of 0.050 inches exposing about 0.050 inches of the upper surface of said second dielectric substrate in alignment with said first three-sided gap and said second three-sided gap.

17. The reduced size GPS microstrip antenna of claim 15 wherein each of said first and second shaped quarter-wavelength microstrip antennas has an overall length of 0.750 inches and an overall width of 0.650 inches.

18. The reduced size GPS microstrip antenna of claim 15 wherein said plurality of copper plated through holes comprises eighteen copper plated through holes.

19. The reduced size GPS microstrip antenna of claim 15 wherein each of said first and second dielectric substrates has a thickness of approximately 0.046 inches.

20. The reduced size GPS microstrip antenna of claim 15 wherein said copper feed for each of said first and second quarter wavelength microstrip antennas corresponds to a 100 ohm input impedance.

* * * * *